US007575343B2

(12) United States Patent
Li et al.

(10) Patent No.: US 7,575,343 B2
(45) Date of Patent: Aug. 18, 2009

(54) FACETED PAR LAMP

(75) Inventors: Jason J. Li, Boxford, MA (US); Harold Rothwell, Jr., Hopkinton, NH (US); David M. Hrubowchak, Lithcfield, NH (US)

(73) Assignee: Osram Sylvania Inc., Danvers, MA (US)

( * ) Notice: Subject to any disclaimer, the term of this patent is extended or adjusted under 35 U.S.C. 154(b) by 3 days.

(21) Appl. No.: 11/804,264

(22) Filed: May 17, 2007

(65) Prior Publication Data

US 2008/0285286 A1 Nov. 20, 2008

(51) Int. Cl.
*F21V 7/00* (2006.01)

(52) U.S. Cl. ..... 362/304; 362/297; 362/309; 362/329; 362/519; 313/113; 313/110; 313/579

(58) Field of Classification Search ..... 362/304, 362/297, 309, 329, 519, 263, 265; 313/113, 313/110, 579
See application file for complete search history.

(56) References Cited

U.S. PATENT DOCUMENTS 2,596,697 A * 5/1952 Krefft ..... 313/114
5,272,408 A * 12/1993 Levin et al. ..... 313/113
6,078,128 A * 6/2000 Gagnon et al. ..... 313/113
6,086,227 A * 7/2000 O'Connell et al. ..... 362/297
2006/0007688 A1* 1/2006 Hough ..... 362/304
2007/0091607 A1* 4/2007 Powell ..... 362/263

* cited by examiner

*Primary Examiner*—Sandra L O'Shea
*Assistant Examiner*—Jessica L McMillan
(74) *Attorney, Agent, or Firm*—William H. McNeill

(57) ABSTRACT

A PAR lamp (10) has a body (12) with an internal reflector surface (14) disposed about a longitudinal axis (16). A cavity (18) is provided at one end (20) of the body (12) and an arc discharge tube (22) that provides a substantially spherical light source is positioned in the cavity (18) and disposed on the longitudinal axis (16). A cover receiving opening (24) is provided at a second end (26) of the body and a cover (27) closes the cover receiving opening (24). A plurality of spiral facets (28) is formed on the internal reflector surface (14), the plurality of spiral facets (28) being sufficient in number to increase the maximum beam candle power and decrease the beam angle when compared to faceted lamps having a lesser number of facets. The number of facets is equal to or greater than 75 and preferably is 100.

3 Claims, 2 Drawing Sheets

FACETED PAR LAMP

TECHNICAL FIELD

This invention relates to PAR lamps and more particularly to PAR lamps having an improved quality of light.

BACKGROUND ART

PAR (parabolic aluminized reflector) lamps are well known in the industry. They are made in flood and spot versions and usually have an incandescent filament as a light source. Such lamps provide adequate amounts of light but have suffered from quality since the beam is fuzzy and shadowed. Some of these problems have been addressed by providing the reflector portion of the lamp with a plurality of facets (for example, U.S. Pat. No. 5,272,408) and others wherein in addition to the faceted reflector the lens of the lamp is also provided with spiral, facets (U.S. Pat. No. 6,086,227). Such lamps yield a smooth circular beam pattern with a perceived sharp beam edge; however, this is accompanied by a subsequent loss of light output, as measured by the maximum beam candle power (MBCP) in candela and an increase in beam angle the full angle measured from the MBCP to 50%.

DISCLOSURE OF INVENTION

It is, therefore, an object of the invention to obviate the disadvantages of the prior art.

It is another object of the invention to enhance the operation of PAR lamps.

Yet another object of the invention is the provision of a PAR lamp having a smooth beam pattern with a sharp beam edge having an increased light output and reduced beam angle.

These objects are accomplished, in one aspect of the invention, by a PAR lamp comprising: a body having an internal reflector surface disposed about a longitudinal axis; a cavity at one end of the body; an arc discharge tube that provides a substantially spherical light source positioned in the cavity and disposed on the longitudinal axis; a cover receiving opening at a second end of the body; a cover closing the cover receiving opening; and a plurality of elongated spiral facets formed on the internal reflector surface, the plurality of facets being sufficient to increase the maximum beam candle power and decrease the beam angle when compared to faceted lamps having a lesser number of facets.

Lamps so constructed have a beam angle reduced by 25% while MBCP is increased 30-50% depending on discharge and arc tube sizes.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
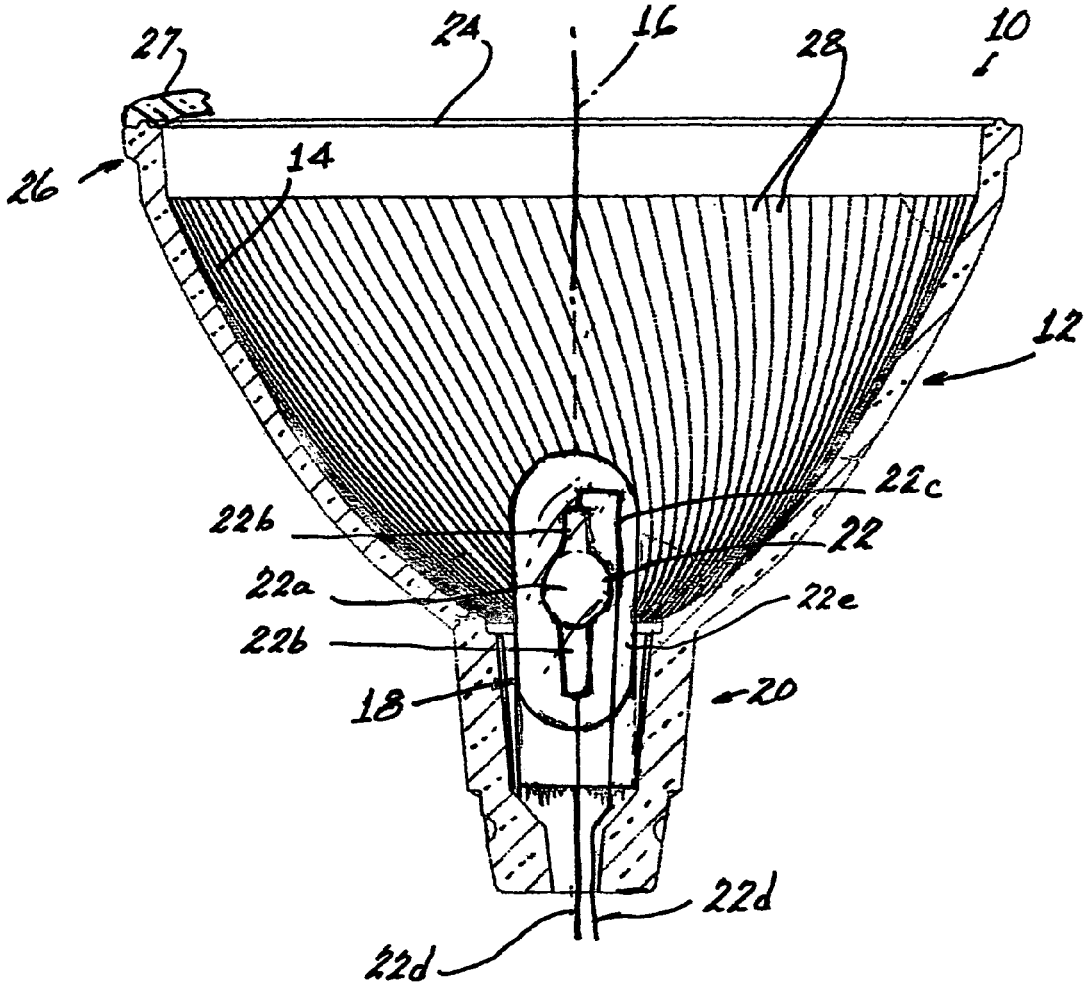
FIG. 1 is an elevational sectional view of an embodiment of the invention.
Figure 2:
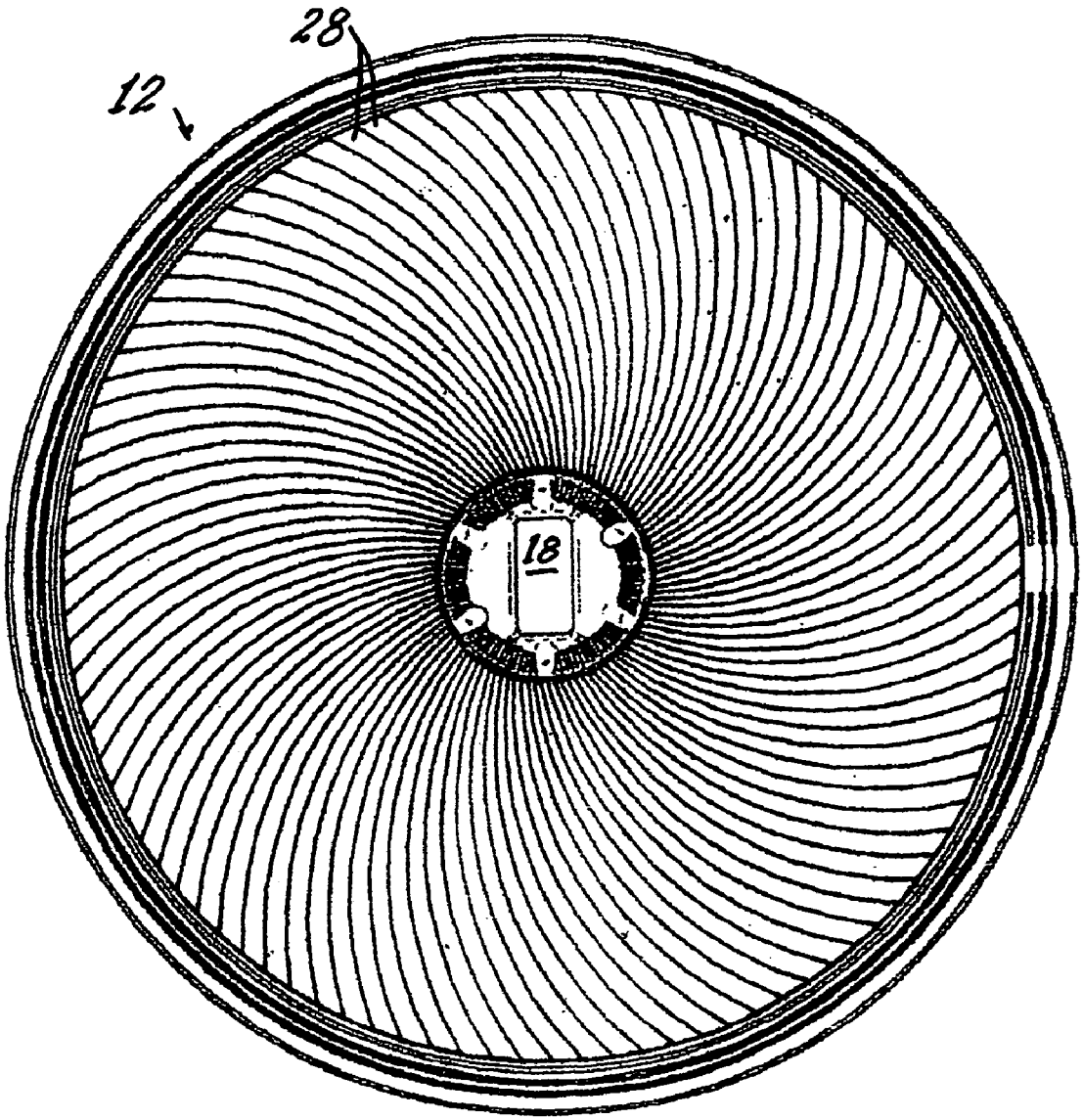
FIG. 2 is a plan view of a lamp body according to an aspect of the invention, with parts omitted for clarity.

Referring now to the drawings with greater particularity, there is shown in FIG. 1 a PAR lamp 10 comprising a body 12 having an internal reflector surface 14 disposed about a longitudinal axis 16. A cavity 18 is formed at one end 20 of the body 12 and an arc discharge tube 22 is positioned in the cavity 18 and disposed on said longitudinal axis 16.

The arc discharge tube 22 has a substantially spherical center 22*a* positioned substantially at the focal point and extending regions 22*b* containing the electrode lead-ins 22*c*, one end of which, 22*d*, project beyond the body for attachment to an electrical power source, as is known. In a preferred embodiment the arc discharge tube is constructed of a ceramic material such as, for example, polycrystalline alumina and is surrounded by glass shroud 22*e*.

The spherical center 22*a* allows for the emission of a substantially spherical light that contributes to the overall effect of the lamp.

A cover receiving opening 24 is formed at a second end 26 of said body and a cover 27, of a suitable configuration, closes the cover receiving opening 24.

A plurality of spiral facets 28 is formed on said internal reflector surface 14, sufficient in number to increase the maximum beam candle power and decrease the beam angle when compared to faceted lamps having a lesser number of facets. The number of facets is greater than 75 and preferably equal to 100.

Each facet of the plurality of facets sweeps an area of 45 degrees from the cavity 18 at the one end 20 to the cover receiving opening 24 at the second end 26.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A PAR lamp comprising:

a body having an internal reflector surface disposed about a longitudinal axis;

a cavity at one end of said body;

an arc discharge tube that provides a substantially spherical light source positioned in said cavity and disposed on said longitudinal axis;

a cover receiving opening at a second end of said body;

a cover closing said cover receiving opening; and a plurality of spiral facets formed on said internal reflector surface, said plurality of facets being sufficient to increase the maximum beam candle power and decrease the beam angle when compared to faceted PAR lamps having a lesser number of facets, each of said plurality of facets sweeping and area of 45 degrees from said cavity at said one end to said cover receiving opening at said second end.

2. The PAR lamp of claim 1 wherein said plurality of spiral facets is equal to a number greater than 75.

3. The PAR lamp of claim 2 wherein said number is equal to 100.

* * * * *